US005713234A

United States Patent [19]

Yamakawa et al.

[11] Patent Number: 5,713,234

[45] Date of Patent: Feb. 3, 1998

[54] PIERCING-ROLLING METHOD AND PIERCING-ROLLING APPARATUS FOR SEAMLESS TUBES

[75] Inventors: Tomio Yamakawa, Kawanishi; Kazuhiro Shimoda, Amagasaki, both of Japan

[73] Assignee: Sumitomo Metal Industries, Ltd., Osaka, Japan

[21] Appl. No.: 700,524

[22] PCT Filed: Jan. 8, 1996

[86] PCT No.: PCT/JP96/00015

§ 371 Date: Aug. 27, 1996

§ 102(e) Date: Aug. 27, 1996

[87] PCT Pub. No.: WO96/21526

PCT Pub. Date: Jul. 18, 1996

[30] Foreign Application Priority Data

Jan. 10, 1995 [JP] Japan ..... 7-001653

[51] Int. Cl.[6] ..... B21B 19/04

[52] U.S. Cl. ..... 72/97

[58] Field of Search ..... 72/97

[56] References Cited

U.S. PATENT DOCUMENTS

| | | | |
|---|---|---|---|
| 3,719,066 | 3/1973 | Okamoto et al. | 72/97 |
| 4,470,282 | 9/1984 | Hayashi | 72/97 |
| 4,827,750 | 5/1989 | Hayashi | 72/97 |

FOREIGN PATENT DOCUMENTS

| | | |
|---|---|---|
| 61-144206 | 7/1986 | Japan . |
| 63-238909 | 10/1988 | Japan . |
| 63-299805 | 12/1988 | Japan . |
| 5-228514 | 9/1993 | Japan . |
| 5-277511 | 10/1993 | Japan . |

*Primary Examiner*—Lowell A. Larson

*Attorney, Agent, or Firm*—Burns, Doane, Swecker & Mathis, LLP

[57] ABSTRACT

A piercing and rolling method involves the use of a piercer provided with cone-shaped main rolls and disk rolls. When a piercing and rolling operation is performed at an expansion ratio of 1.15 or more, the following relations (1), (2), (3), (4), and (5) are satisfied:

$$3 \leqq D1/d \leqq 7 \quad (1)$$

$$9 \leqq D2/d \leqq 16 \quad (2)$$

$$2 < D2/D1 \leqq 3 \quad (3)$$

$$2.5° \leqq \theta 1 \leqq 4.5° \quad (4),$$

and $$3° \leqq \theta 2 \leqq 6.5° \quad (5).$$

wherein D1: diameter of the gorge portion of a main roll; D2: diameter at the grooved portion of a disk roll; d: outer diameter of a billet; θ 1: inlet face angle of a main roll, and θ 2: outlet face angle of a main roll. The apparatus of the present invention is designed so that D1 is between 510 and 2000 mm inclusive and D2 is between 1,530 and 4,000 mm inclusive, and that the above-described relations (3), (4), and (5) are satisfied. It is possible through use of the present invention to perform a piercing and rolling operation without causing misrolling such as incomplete engagement of billets Or incomplete rolling of the bottom. The resultant hollow shells do not possess defects on the outer and interior surfaces thereof. In addition, enlargement of the outer diameter at the bottom portion of a hollow shell, which may invite problems in subsequent rolling steps for elongation, can be prevented.

3 Claims, 9 Drawing Sheets

PIERCING-ROLLING METHOD AND PIERCING-ROLLING APPARATUS FOR SEAMLESS TUBES

TECHNICAL FIELD

The present invention relates to a piercing-rolling method and a piercing-rolling apparatus for seamless tubes, which makes use of inclined rolling mills adopted in the Mannesman tube-making method, a typical method for manufacturing seamless tubes.

BACKGROUND ART

Seamless tubes such as steel seamless tubes are widely used, for example, as steel oil well casings, tubing, and drill pipes, line pipes, steel tubes for heat exchangers, steel tubes for piping, and steel tubes for bearings. Seamless tubes used for such purposes are typically made of carbon steel, low alloy steels containing alloy components such as Cr and Mo, high Cr stainless steels, Ni-based alloy, or titanium. Seamless steel tubes are generally manufactured by the Mannesman-plug mill method or the Mannesman-mandrel mill method. When seamless tubes are manufactured using these methods, the following steps are performed: First, a round bar-shaped billet (hereinafter simply referred to as a billet) is heated in a heating furnace to a predetermined temperature, and the heated billet is pierced using a piercer which is an inclined rolling mill, thereby transforming the billet into a hollow shell. The hollow shell is rolled to elongate by means of a plug mill or a mandrel mill to reduce its wall thickness. Moreover, the outer diameter, among other dimensions, is reduced using a reducing mill such as a sizer or a stretch reducer so as to form a seamless tube having an intended geometry.

The above-mentioned piercer is usually composed of barrel-shaped or cone-shaped main rolls whose center axes are inclined with respect to the pass center of a billet or a hollow shell, a plug serving as an inside restriction tool, and a guide shoe or a disk roll for guiding material to be pierced and rolled (hereinafter simply referred to as a material to be pierced).

FIG. 1 depicts a schematic plan view showing the structure of a piercer which is generally used; FIG. 2 depicts a schematic side view of this piercer; and FIG. 3 depicts a cross section cut along line I—I in FIG. 1. In FIGS. 1 through 3, 10A and 10B are main rolls, and each main roll has a gorge portion 11 of diameter D1 in the middle thereof with respect to the direction of center axis. On the inlet side of the gorge portion 11 (on the left side in FIGS. 1 and 2) there is provided an inlet face 12 having the shape of a truncated cone whose base of smaller diameter defines one end face of the main roll.

On the outlet side of the gorge 11 (on the right side in FIGS. 1 and 2) is provided an outlet face 13 having the shape of a truncated cone whose base of larger diameter defines the other end face of the main roll. The inlet face angle formed by pass line X—X and the inlet face is expressed as θ 1, whereas the outlet face angle formed by pass line X—X and the outlet face is expressed as θ 2. Thus, each main roll has an overall cone-like shape, and a pair of such rolls are placed in a horizontally or vertically opposing manner, with pass line X—X therebetween.

The center axis of each main roll is three-dimensionally inclined with respect to the pass line. A cross angle γ is determined to be the angle formed by the center axis of a main roll and pass line X—X, as shown in FIG. 1. Also, a feed angle β is determined to be the angle formed by the center axis of a main roll and pass line X—X, as shown in FIG. 2. The paired rolls are arranged in an opposing manner so that the roll spacing Rg at the gorge portion 11 comes to have a predetermined value.

If the cross angle is γ (not zero) and the feed angle β is zero, then the above-mentioned inlet face angle θ 1 is equal to the angle formed by pass line X—X and the inlet face 12, and the above-mentioned outlet face angle θ 2 is equal to the angle formed by pass line X—X and the outlet face 13.

A plug 2 has a generally bullet-head shape, and is supported at its rear end by the top end of a mandrel bar M connected to a thrust block (omitted in Figures). Plug 2 is held between main rolls 10A and 10B, with its center axis almost coinciding with pass line X—X. Plug 2 is rotatable about pass line X—X.

Each of disk rolls 30*u* and 30*d* has a concave or grooved outer periphery, which opposes the plug 2. Each has a disk shape, and as shown in FIG. 3, the diameter measured at the bottom of the grooved periphery 14 is expressed as D2. The diameter D2 is greater than the diameter of the gorge portion of a main roll. The two disk rolls are oriented in a direction approximately perpendicular to the main rolls 10A and 10B and are disposed in a vertically or horizontally opposing manner with respect to pass line X—X. These disk rolls are driven by a drive motor (omitted in Figures) so as to be rotated in the directions indicated by the arrows.

When a piercing and rolling operation is performed using the above-described piercer, a billet B is first heated to a predetermined temperature in a heating furnace, and is then fed in the direction indicated by a white arrow until it is pinched between inlet faces 12, 12 of main rolls 10A and 10B. Thereafter, the billet B advances while being rotated by the drive rotation of the main rolls 10A and 10B, thereby moving spirally. During this process, the main rolls 10A and 10B and the plug 2 reduce the thickness of the billet B so as to transform it into a hollow shell H. At this time, the peripheral surfaces of the disk rolls 30*u* and 30*d*, which are driven to rotate synchronously with the spiral rotation of the material to be pierced, billet B, suppress shaking of billet B to prevent enlargement of the outer diameter of the hollow shell H.

As a highly efficient piercing and rolling method using such a piercer to produce products of high quality, there is a method previously proposed by the inventors of the present invention (Japanese Patent Application Laid-Open (kokai) Nos. 63-238909 and 63-299805).

According to the method described in Japanese Patent Application Laid-Open (kokai) No. 63-238909, the cross angle γ and the feed angle γ are set to predetermined values, and the distribution ratio of rolling reduction is defined in terms of reduction strain in the radial direction of a billet to be pierced and that in the peripheral direction of the billet. In this method, this setting of conditions is employed in order to prevent malfunctions such as stoppage of rolling caused by flaring of a hollow shell during piercing and bulging of the billet between main rolls and a guide. Moreover, according to this method, incomplete release from the main rolls can also be prevented, since the spacing between the outer periphery of a plug and the inner periphery of a hollow shell decreases so as to prevent the plug from being released from the hollow shell.

In the method disclosed in Japanese Patent Application Laid-Open (kokai) No. 63-299805, the diameter D1 of the gorge portion of a main roll and the outer diameter d of a billet B are set so as to satisfy the relations $2.5 \leqq D1/d \leqq 4.5$. Due to this setting, a forging effect (Mannesman effect) of a material to be pierced, which causes internal defects, can be prevented. In addition, shear strain in the radial direction is suppressed, thereby yielding hollow shells of a high quality which do not have internal defects.

These methods attempt to facilitate the manufacture of tubes having a thin wall thickness at a high degree of working, and to considerably reduce manufacturing cost.

However, if disk rolls are used as guides for a material to be pierced employed in the above-mentioned Japanese Patent Application Laid-Open (kokai) Nos. 63-238909 and 63-299805, there may sometimes result, depending on the diameter of the disk rolls and the inlet and outlet face angles of the main rolls, incomplete engagement of the material to be pierced or incomplete rolling of the bottom of the resultant shell, the latter being caused by the phenomenon in which the bottom portion of the material to be pierced does not come off the main rolls. In addition, a so-called singular shape phenomenon (hereinafter referred to as enlargement of the outer diameter of the bottom), shown in FIG. 4, sometimes occurs. This is a phenomenon in which the bottom portion of a hollow shell which has undergone piercing and rolling has an increased diameter which decreases at the bottom end. Although this phenomenon does not cause any problem in the middle of a piercing and rolling operation, it sometimes happens that part of this bulged portion does not go through the disk roll caliber, inviting problems in rolling.

Moreover, another problem has been newly identified: in the case where the expansion ratio of outer diameter (outer diameter of a hollow shell/outer diameter of a billet before being pierced) at the time of piercing and rolling is not less than 1.15, i.e., the outer diameter of a hollow shell is that much greater than that of its corresponding billet, the outer surface of the hollow shell frequently generates defects.

The present invention was made in an attempt to solve the above-described problems, and an object of the present invention is to provide a method and apparatus for the manufacture of hollow shells having excellent surface quality without inviting any problem during rolling, and more specifically, to provide a method and apparatus for piercing and rolling seamless steel tubes having excellent surface quality, in which enlargement of the outer diameter of the bottom of a material to be pierced can be suppressed, and generation of defects in the outer surface of a resultant tube can be suppressed even when piercing is performed at an expansion ratio of outer diameter of not less than 1.15.

DISCLOSURE OF THE INVENTION

The objectn of the present invention is to provide a piercing-rolling method and a piercing-rolling apparatus for seamless tubes, in which enlargement Of the outer diameter of the bottom of a pierced material can be suppressed, and generation of defects in the outer surface of a resultant tube can be suppressed even when piercing is performed at an expansion ratio of outer diameter of not less than 1.15.

The method according to the present invention is characterized in that a raw material is pierced and rolled by the use of a piercer equipped with cone-shaped main rolls and disk rolls under conditions which satisfy the following relations (1) through (5):

$$3 \leq D1/d \leq 7 \quad (1)$$

$$9 \leq D2/d \leq 16 \quad (2)$$

$$2 < D2/D1 \leq 3 \quad (3)$$

$$2.5° \leq \theta 1 \leq 4.5° \quad (4)$$

$$3° \leq \theta 2 \leq 6.5° \quad (5)$$

wherein

D1: diameter of the gorge portion of a main roll,

D2: diameter at the grooved portion 14 of a disk roll, d: outer diameter of a billet, θ 1: inlet face angle of a main roll, and θ 2: outlet face angle of a main roll.

Moreover, the piercing and rolling apparatus of the present invention is characterized in that it includes a piercer equipped with cone-shaped main rolls and disk rolls, in which diameter D1 of the gorge portion of a main roll is 510–2,000 mm, diameter D2 of the grooved portion of a disk roll is 1,530–4,000 mm, and the ratio of the diameter of the grooved portion of a disk roll to the diameter of the gorge portion of a main roll (D2/D1), the inlet face angle of a main roll (θ1), and the outlet face angle of a main roll (θ 2) satisfy the above-described relations (3), (4), and (5).

The piercing and rolling method for the manufacture of seamless tubes according to the present invention makes it possible to manufacture hollow shells of carbon steel, low alloy steels, high alloy steels, etc., from round billets of these materials, without inviting misrolling such as incomplete engagement and incomplete piercing of the bottom of the tube material. The resultant hollow shells have a reduced number of defects in their outer surfaces and enlargement of the outer diameter of the bottom is suppressed. Therefore, quality of the seamless tube products are remarkably good. Moreover, since the method and apparatus of the present invention enable stable piercing and rolling at a high expansion ratio of outer diameter of not less than 1.15, a wider range of seamless tube products can be produced with enhanced productivity. Accordingly, by the use of the method and apparatus of the present invention, a wide variety of tube products can be manufactured efficiently at reduced costs.

BEST MODE FOR CARRYING OUT THE INVENTION

The inventors of the present invention first conducted research for suppressing enlargement of the outer diameter of the bottom of a hollow shell.

Figure 1:
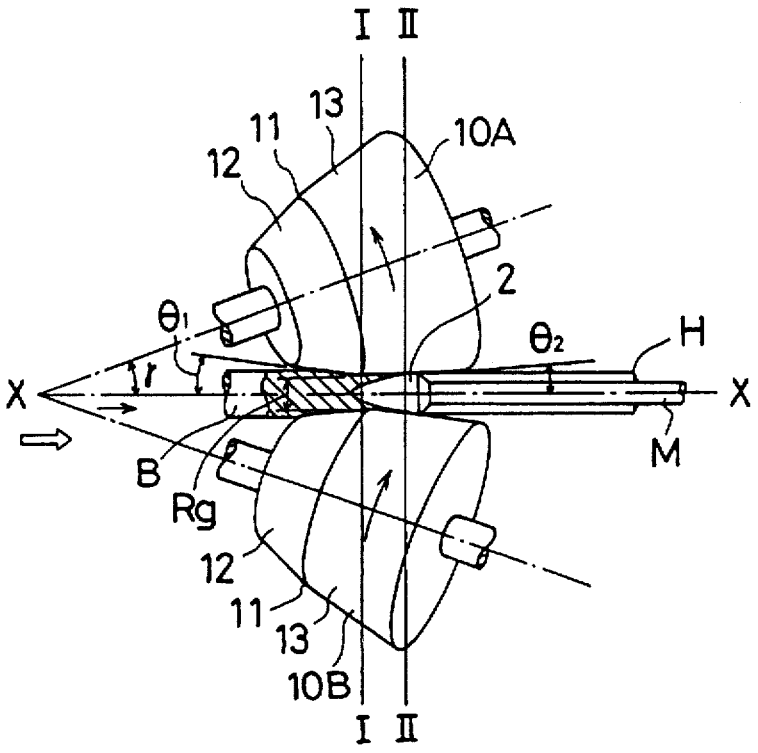
FIG. 1 is a schematic plane view of a piercer for explaining a conventional piercing and rolling method and apparatus.
Figure 2:
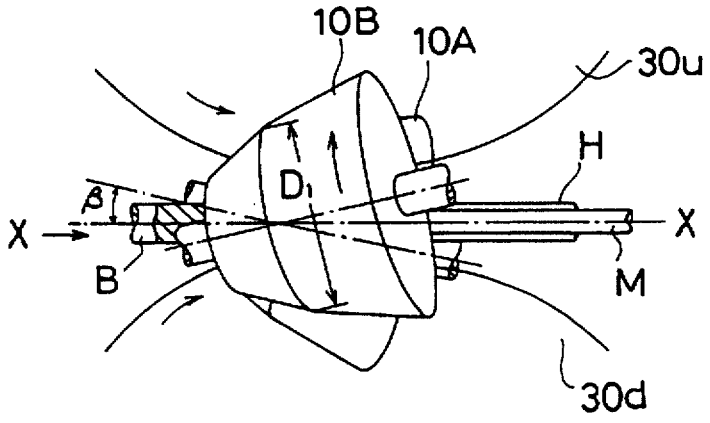
FIG. 2 a schematic side view of a piercer for explaining a conventional piercing and rolling method and apparatus.
Figure 3:
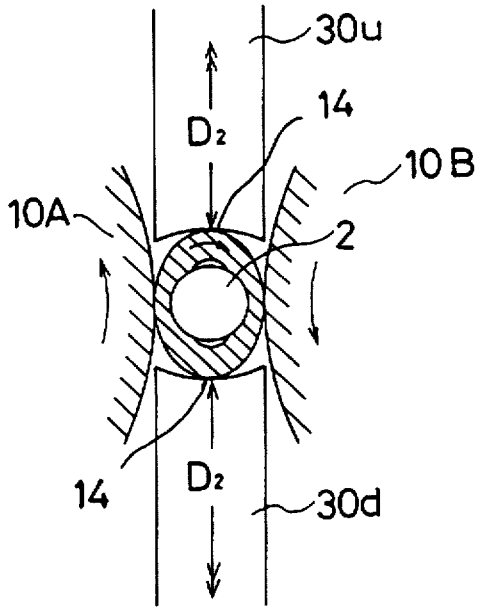
FIG. 3 depicts a cross section cut along line I—I in FIG. 1.
Figure 5:
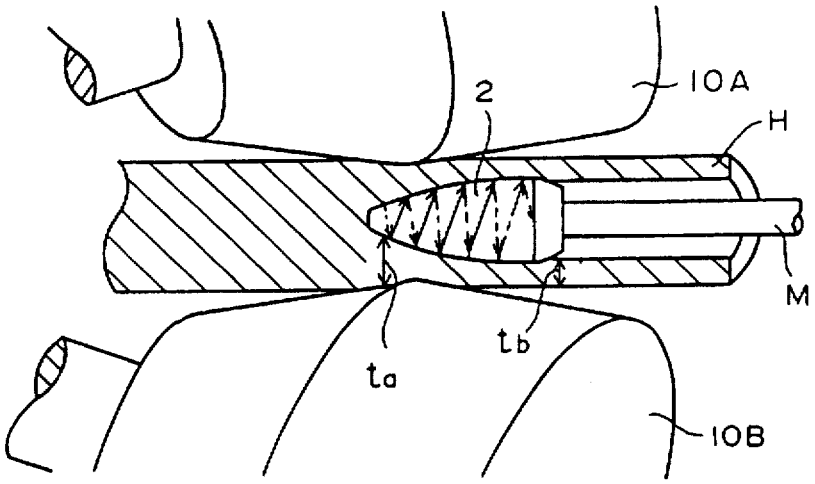
FIG. 5 is a schematic plan view for showing the process of piercing and rolling.
Figure 6:
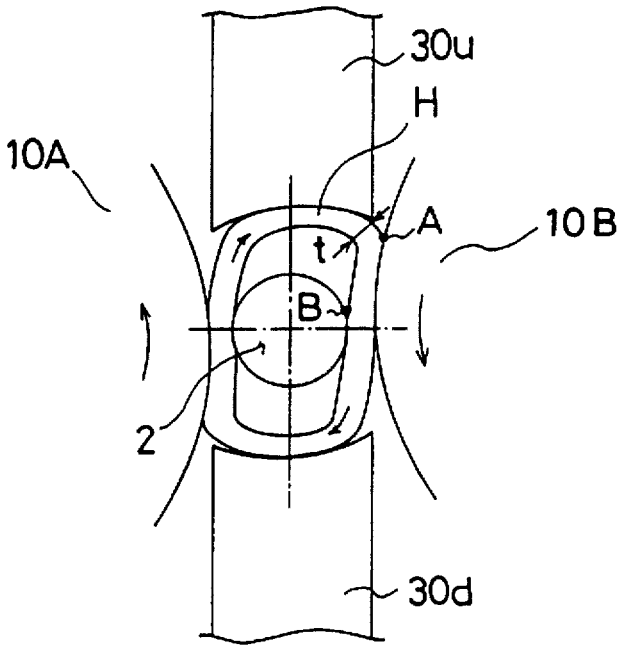
FIG. 6 depicts a cross section cut along line II—II in FIG. 1 for showing a process of reducing the wall thickness of a hollow shell.

FIG. 5 is a schematic plane view for showing the process of piercing and rolling, and FIG. 6 shows a cross section cut along line II—II in FIG. 1 for showing a process of reducing the wall thickness of a hollow shell. The mechanism of piercing and rolling is shown using FIGS. 5 and 6.

As shown in FIG. 5, the material to be pierced advances as it rotates spirally. Therefore, during a half rotation of the material to be pierced, as shown by the arrows, wall thickness (ta) is reduced. In this way, the material repeatedly undergoes thickness rolling, by main rolls 10A and 10B and a plug 2, until it is transformed into a hollow tube having a wall thickness of (tb). As shown in FIG. 6, when thickness rolling is performed, during a half rotation of the material to be pierced, the outer surface of a hollow shell H which undergoes rolling comes into contact with the main roll 10B at point A, after which the inner surface of the hollow shell H comes into contact with the outer surface of the plug 2 at point B. In this period, the hollow shell H has a portion having a thick wall which is in the so-called state of being rolled without tool, i.e., not restricted by the inside tool, plug 2. This results in an increase in wall thickness between points A and B. At the position where the hollow shell contacts disk roll 30*u* or 30*d*, a reduction in outer diameter occurs by the application of a pressing force onto the outer periphery of the hollow shell H. As described above, the walls in which the wall thicknesses have increased undergo a thickness rolling by the main rolls 10A, 10B, and the plug 2. A cycle of increase in wall thickness and working to reduce wall thickness occurs every half rotation of the material to be pierced, and this cycle is repeated until a hollow shell H having a predetermined dimension is obtained, thereby completing a piercing and rolling operation.

The present inventors focused on the increase in wall thickness, and studied how diameter D1 of the gorge portion of main rolls 10A and 10B, diameter D2 of the grooved portion of disk rolls 30*u* and 30*d*, and outer diameter d affect the increase in wall thickness.

Figure 7:
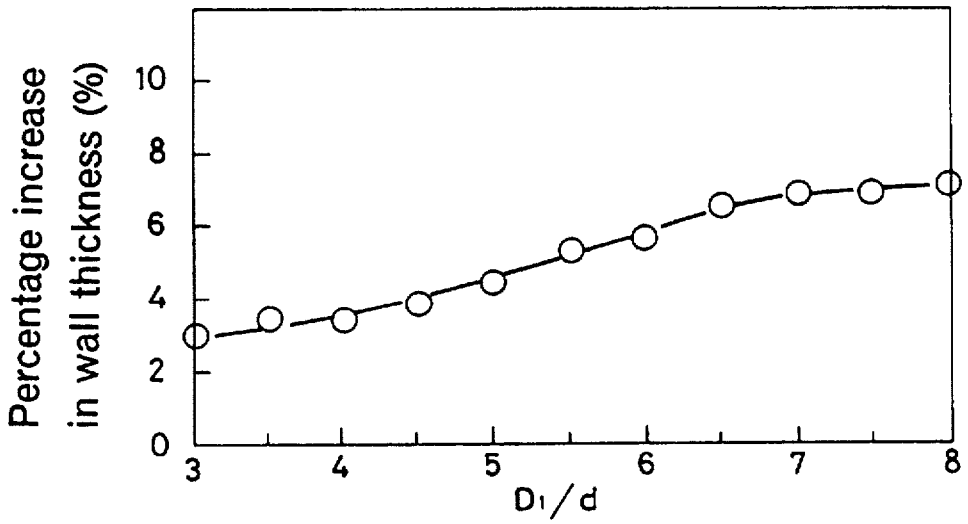
FIG. 7 is a graph showing the relation between the ratio of the diameter of the gorge portion of a main roll (D1) to the outer diameter of a billet (d), which is the material to be pierced and rolled, (D1/d), and the percentage increase in wall thickness of the hollow shell which has undergone piercing and rolling.
Figure 8:
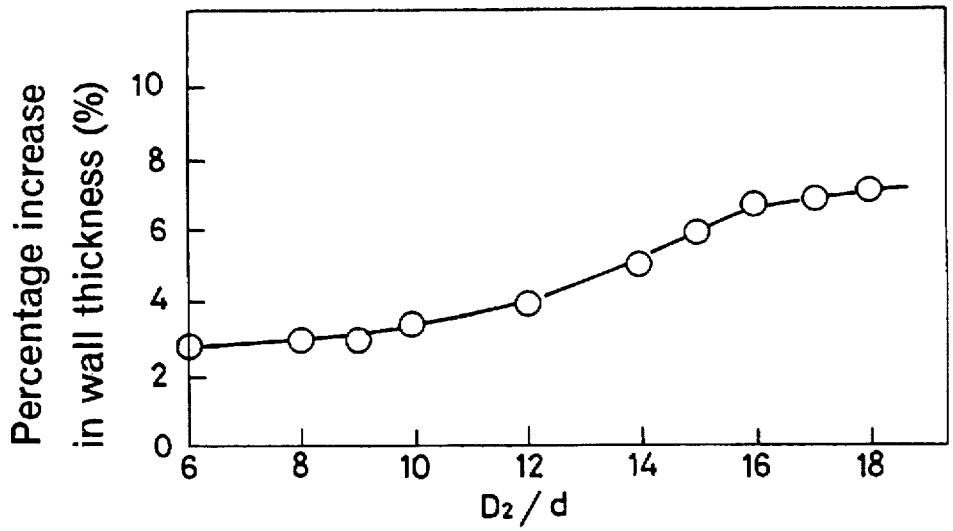
FIG. 8 is a graph showing the relation between the ratio of the diameter of the grooved portion of a disk roll (D2) to the outer diameter of a billet (d), which is the material to be pierced and rolled, (D2/d), and the percentage increase in wall thickness of the hollow shell which has undergone piercing and rolling.

FIG. 7 shows the results of a test in which increase in wall thickness of a hollow shell was investigated through subjecting a hollow shell, serving as a test material, to rolling under conditions in which the value D1/d was changed in the range shown in Table 1 while the value D2/d was maintained constant. FIG. 8 shows the results of a test in which increase in wall thickness of a hollow shell was investigated through subjecting a hollow shell, serving as a test material, to rolling under conditions in which the value D2/d was changed in the range shown in Table 2 while the value D1/d was maintained constant.

TABLE 1

| | |
|---|---|
| Outer diameter of the hollow shell (d) | 50–110 mm |
| Ratio of wall thickness (t) to outer diameter of the hollow shell (d):(t/d) | 0.1 |
| Material of the hollow shell | Carbon steel (0.45% C) |
| D1/d | 3–8 |
| D2/d | 14 |
| Reduction in outer diameter during rolling | 10% |

TABLE 2

| | |
|---|---|
| Outer diameter of the hollow shell (d) | 50–110 mm |
| Ratio wall thickness (t) to outer diameter of the hollow shell (d):(t/d) | 0.1 |
| Material of the hollow shell | Carbon steel (0.45% C) |
| D1/d | 6–18 |
| D2/d | 4.5 |
| Reduction in outer diameter during rolling | 10% |

As is apparent from FIGS. 7 and 8, in each case, there is a tendency in which increase in wall thickness of a hollow shell after rolling, i.e., [{(wall thickness after rolling—wall thickness before rolling)÷wall thickness before rolling}× 100 (%)], increases as the values D1/d and D2/d increase.

This phenomenon of increase in wall thickness also occurs during the process of piercing and rolling a billet B using a piercer to transform it into a hollow shell H. The wall portion having an increased thickness is rolled so as to reduce its wall thickness to a target wall thickness while it is processed by the plug 2 and the main rolls 10A and 10B.

Figure 9:
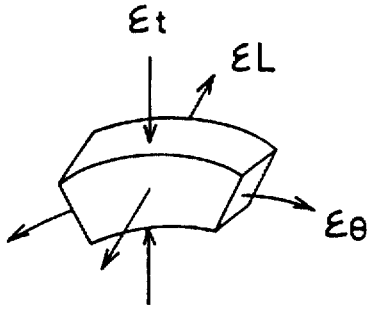
FIG. 9 depicts distribution of strain in thickness rolling using a plug and main rolls.

As shown in FIG. 9, at a portion where the wall thickness is reduced, rolling proceeds while the reduction strain $\epsilon$ t in the direction of wall thickness is distributed between a strain $\epsilon$ L in the direction of the tube axis (rolling direction) and a strain $\epsilon$ $\theta$ in the circumferential direction.

Figure 4:
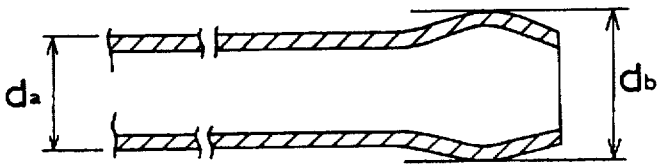
FIG. 4 depicts enlargement of the outer diameter of the bottom of a hollow shell which occurs when a tube is pierced and rolled by a conventional method.

However, when the above-described rolling operation is performed, at the bottom portion of a billet B, where piercing is in an unstable state, the distribution ratio of reduction strain $\epsilon$ t between a strain in the axial direction $\epsilon$ L and a strain in the circumferential direction $\epsilon$ $\theta$ is not the same as that in portions which undergo stable rolling. In detail, at the bottom portion of a billet B, where rolling is unstable; i.e., the material to be pierced does not at all contact main rolls 10A and 10B, the strain in the axial direction $\epsilon$ L is small, and therefore, $\epsilon$ t is nearly equal to the strain in the circumferential direction $\epsilon$ $\theta$. Therefore, the outer diameter of the hollow shell increases to cause, as shown in FIG. 4, a phenomenon of enlargement of the outer diameter at the bottom of the hollow shell which has been pierced and rolled.

Figure 10:
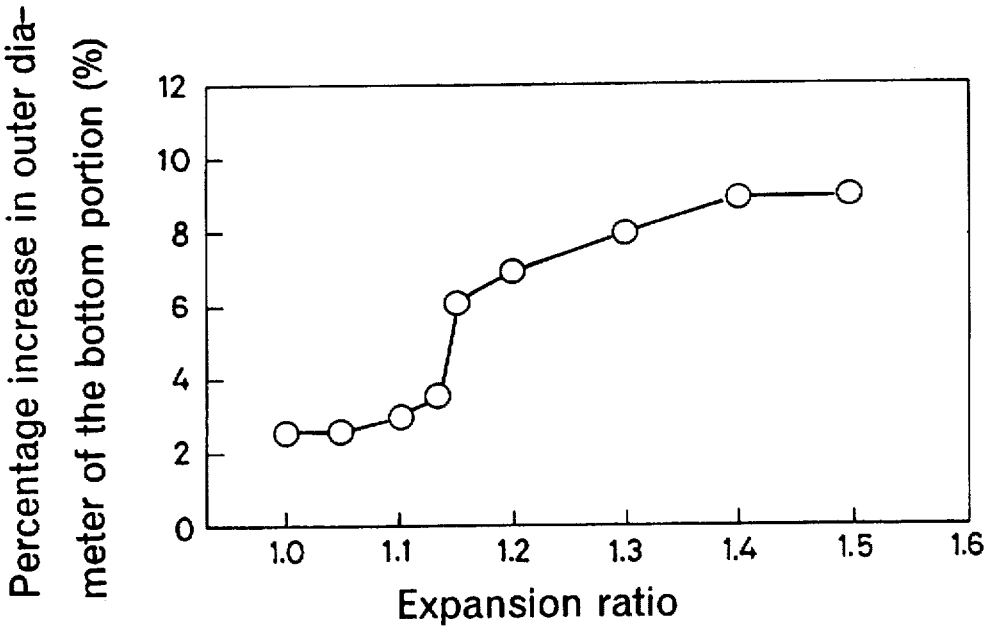
FIG. 10 is a graph showing the relation between the expansion ratio of outer diameter and the percentage enlargement of the outer diameter at the bottom portion of a hollow shell, where the outer diameter has been enlarged.

FIG. 10 is a graph showing the results of a test in which a billet was pierced and rolled into a hollow shell under conditions shown in Table 3 while varying the expansion ratio of the outer diameter. In FIG. 10, the horizontal axis represents the expansion ratio of the outer diameter, and the vertical axis represents the percentage increase in the outer diameter of the bottom portion of the hollow shell [{(db-da)÷da}×100 (%)], wherein the outer diameter of a portion of a hollow shell which undergoes a stationary rolling is expressed by da and a maximum outer diameter at the bottom portion in which the outer diameter was enlarged is expressed by db.

TABLE 3

| | |
|---|---|
| Outer diameter of the billet (d) | 70 mm |
| Material of the billet | Carbon steel (0.2% C) |
| Expansion ratio of outer diameter | 1.0–1.5 |
| Ratio of wall thickness (t) to outer diameter of the hollow shell (d) | 0.05 |
| Cross angle of the main roll ($\gamma$) | 20° |
| Feed angle of the main roll ($\beta$) | 8°–16° |
| Diameter of the gorge portion in the main roll (D1) | 350 mm |
| Diameter of the disk roll (D2) | 850 mm |
| Inlet face angle of the main roll ($\theta$ 1) | 3.5° |
| Outlet face angle of the main roll ($\theta$ 2) | 4° |
| Spacing of main rolls (Rg) | 61.5 mm |
| Spacing of disk rolls (Dg) | 70.5 mm |

As is apparent from FIG. 10, when a normal piercing and rolling operation was performed in which the expansion ratio of the outer diameter was between around 1.0 and 1.05, the percentage increase in the outer diameter at the bottom portion with an increased outer diameter was less than 3%, and when the expansion ratio was between 1.05 and 1.15, the percentage increase in the outer diameter was also as small as 4% or less. Thus, the percentage increases were not problematic in the subsequent rolling step using mandrel mills. However, when a piercing and rolling operation was performed in which the expansion ratio was not less than 1.15, problems in rolling were caused in the subsequent rolling step using mandrel mills, since the percentage increase in the outer diameter at the bottom portion with an enlarged outer diameter was significantly high: 6% or greater.

Next, the piercing and rolling method and apparatus of the present invention, which was accomplished based on the above-described investigation, will be described in detail with reference to the appended drawings.

Figure 11:
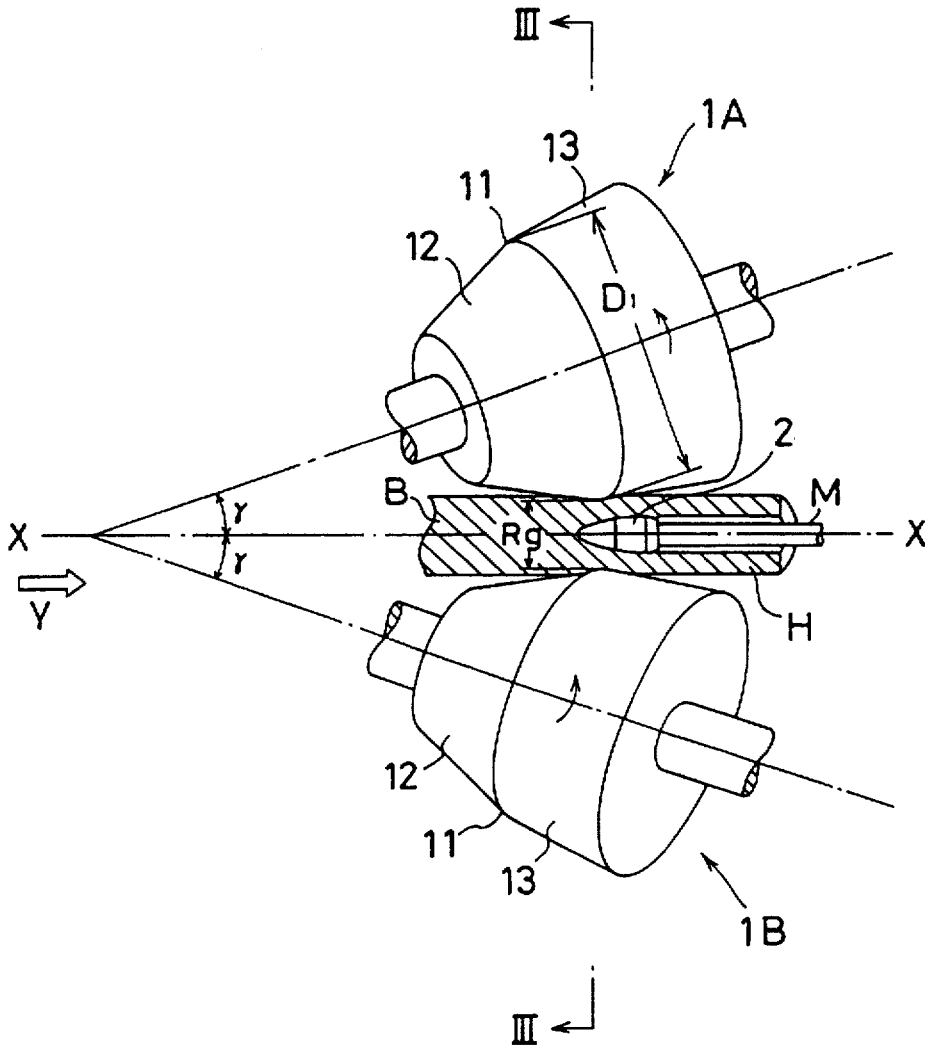
FIG. 11 is a schematic plane view of a piercer for explaining the piercing and rolling method and apparatus of the present invention.
Figure 12:
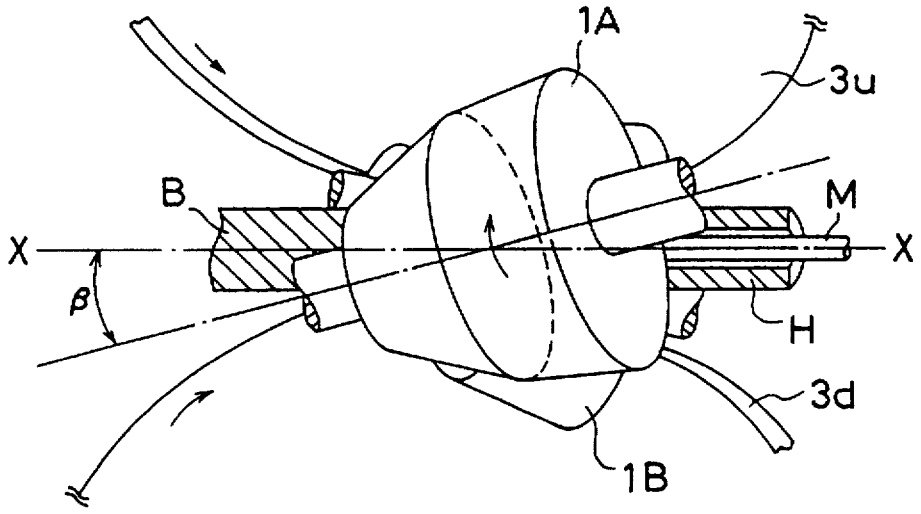
FIG. 12 is a schematic side view of a piercer for explaining the piercing and rolling method and apparatus of the present invention.
Figure 13:
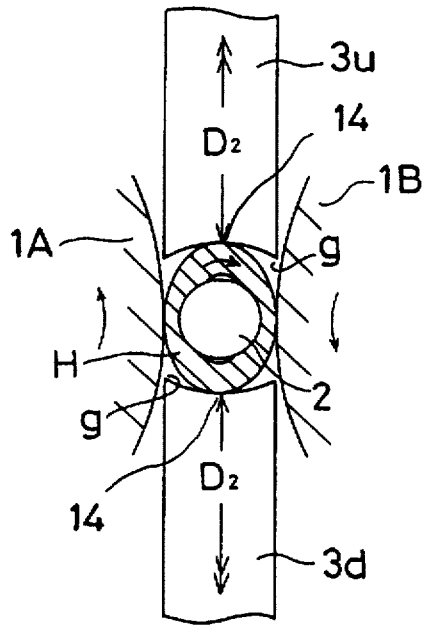
FIG. 13 depicts a cross section cut along line III—III in FIG. 11.
Figure 14:
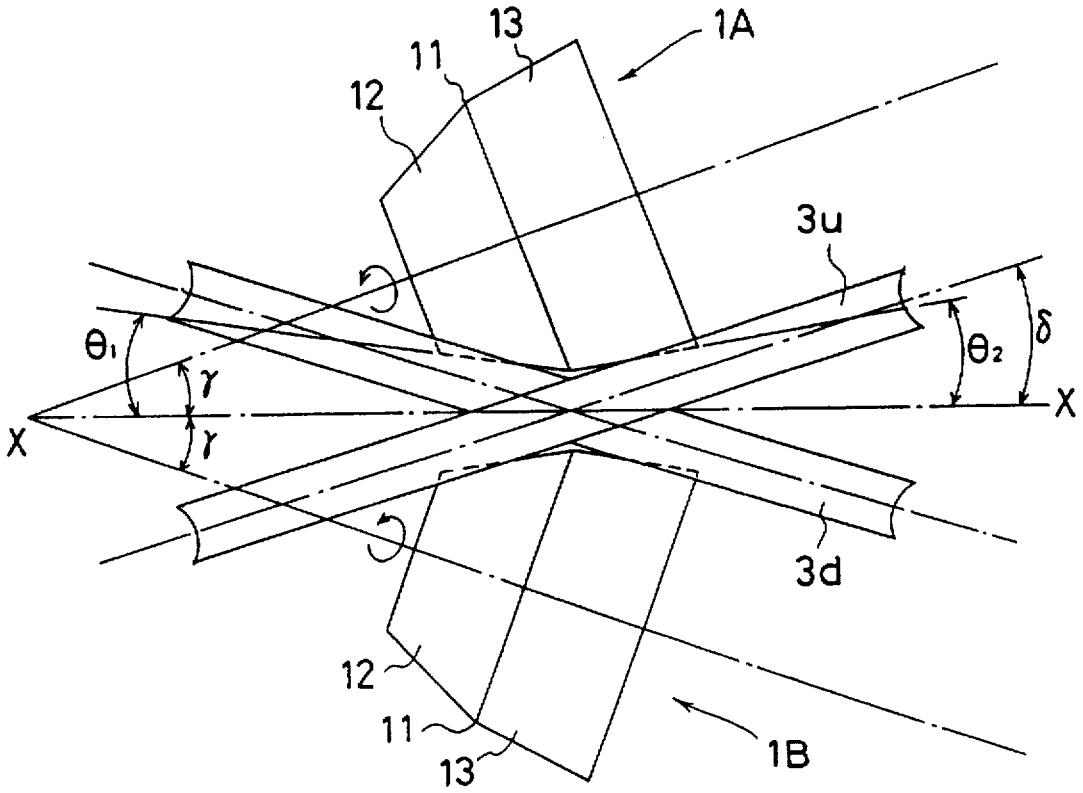
FIG. 14 depicts a piercer for explaining the piercing and rolling method and apparatus of the present invention, showing the case in which main rolls are arranged so that the feed angles are equal to 0 for the sake of simplification.

FIG. 11 is a schematic plane view of a piercer for performing the piercing and rolling method of the present invention; FIG. 12 is a schematic side view of the piercer; FIG. 13 depicts a cross section cut along line III—III in FIG. 11; and FIG. 14 is a diagram of a piercer for performing the piercing and rolling method of the present invention, showing the case in which main rolls are arranged so that the feed angles are equal to 0, for the sake of simplicity.

In FIG. 11 through 14, main rolls 1A and 1B each have a gorge portion 11 of diameter D1 in the middle portion thereof with respect to the direction of the center axis. On the inlet side of the gorge portion 11 (on the left side in FIG. 11) there is provided an inlet face 12 having the shape of a truncated cone whose base of smaller diameter defines one end face of the main roll.

On the outlet side of the gorge 11 (on the right side in FIG. 11) is provided an outlet face 13 having the shape of a truncated cone whose base of larger diameter defines the other end face of the main roll. The inlet face angle formed by pass line X—X and the inlet face 12 is expressed as $\theta$ 1, whereas the outlet face angle formed by pass line X—X and the outlet face 13 is expressed as $\theta$ 2. Thus, each main roll has an overall cone-like shape, and a pair of such rolls are placed in a horizontally or vertically opposing manner, with pass line X—X therebetween.

The center axis of each main roll is three-dimensionally inclined with respect to the pass line. A feed angle $\beta$ is determined to be the angle formed by the center axis of a main roll and pass line X—X, as shown in FIG. 12. A cross angle $\gamma$ is determined to be the angle formed by the center axis of a main roll and pass line X—X, as shown in FIG. 14. The paired rolls are arranged in an opposing manner so that the roll spacing Rg at the gorge portion 11 comes to have a predetermined value.

If the cross angle is $\gamma$ (not zero) and the feed angle $\beta$ is zero, then the above-mentioned inlet face angle $\theta$ 1 is equal to the angle formed by pass line X—X and the inlet face 12, and the above-mentioned outlet face angle $\theta$ 2 is equal to the angle formed by pass line X—X and the outlet face 13.

A plug 2 has a generally bullet shape, and is supported at its rear end by the top end of a mandrel bar M connected to a thrust block (omitted in Figures). The plug 2 is held between main rolls 1A and 1B, with its center axis almost coinciding with pass line X—X. Plug 2 is rotatable about pass line X—X.

Figure 15:
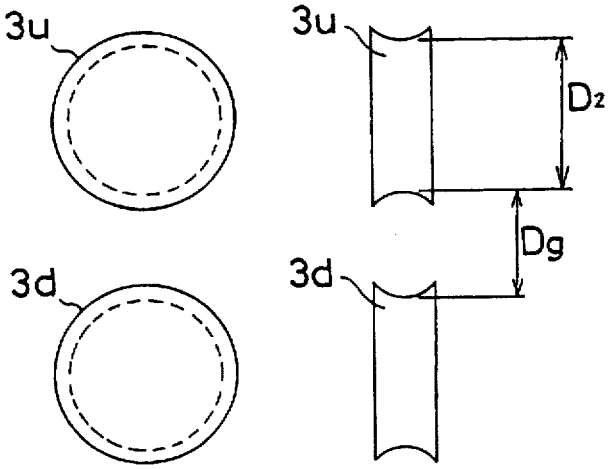
FIG. 15 is a schematic view showing the spacing of disk rolls and their configurations.

As shown in FIG. 15, each of disk rolls **3*u* and 3*d* has a concave or grooved outer periphery, which opposes the plug 2. Each has a disk shape, and as shown in FIG. 13, the diameter measured at the bottom of the grooved periphery 14 is expressed as D2, which is greater than the diameter of the gorge portion of a main roll. The two disk rolls are oriented in a direction approximately perpendicular to the main rolls 1A and 1B** and are disposed in a vertically or horizontally opposing manner with respect to pass line X—X. These disk rolls are driven by a drive motor (omitted in Figures) so as to be rotated, in the directions indicated by the arrows, synchronously with the spiral rotation of the material to be pierced, i.e., a billet B.

As shown in FIG. 14, the disk rolls **3*u* and 3*d* are arranged so as to be skewed at a predetermined skew angle $\delta$ with respect to pass line X—X. As a result, on the downstream side of the gorge portions 11 of main rolls 1A and 1B, the distance g (see FIG. 13) between outlet face 13 of main roll 1A or 1B, located on the upstream side of the rotating hollow shell H, and disk roll 3*u* or 3*d*** is reduced so as to prevent misrolling, thereby stabilizing the piercing and rolling operation.

The disk rolls **3*u* and 3*d*** may be disposed in an opposing manner such that their rotation center axis are vertical to pass line X—X; in other words, such that the skew angle $\delta$ becomes zero.

When a billet B is pierced and rolled using a piercer constituted as described above, a billet B having a round bar shape is first heated in a heating furnace to a temperature which allows piercing, and is then fed in the direction indicated by a white arrow(see FIG. 11) until it is pinched between inlet faces 12, 12 of main rolls 1A, 1B. Thereafter, the billet B advances while being rotated and urged by the rotation of the main rolls 1A and 1B, thereby moving spirally. During this process, the main rolls 1A and 1B and the plug 2 reduce the thickness of the billet B so as to transform it into a hollow shell H. At this time, as shown in FIG. 13, the peripheral grooved surfaces of the disk rolls 3*u* and 3*d*, which are driven to rotate synchronously with the spiral rotation of billet B serving as the material to be pierced, suppress shaking of billet B so as to prevent enlargement of the outer diameter of the hollow shell H.

In the present invention, when a piercing and rolling operation is performed with an expansion ratio of not less than 1.15, it is preferred that the cross angle γ of cone-shaped main rolls 1A and 1B be set to not more than 25°. Moreover, D1/d (the ratio of the diameter of the gorge portion of a main roll (D1) to the diameter of a billet (d)), D2/d (the ratio of the diameter of the grooved portion of a disk roll (D2) to the diameter of the billet (d)), D2/D1 (the ratio of the diameter of the grooved portion of a disk roll (D2) to the diameter of the gorge portion of a main roll (D1)), θ 1 (inlet face angle of a main roll), and θ 2 (outlet face angle of a main roll) are set so as to fall within the ranges defined by the above-described relations (1) through (5).

By performing a piercing and rolling operation under the conditions defined by the present invention, it is possible to prevent misrolling such as that involving incomplete engagement of a billet with main rolls and that involving incomplete rolling of the bottom of a tube material. Moreover, it is possible to prevent enlargement in the outer diameter of the bottom portion of a hollow shell, which is a phenomenon causing problems in subsequent rolling steps using mandrel mills, etc.; as well as to prevent generation of defects in the outer surface of the resultant tube.

Next, conditions for performing piercing and rolling of the present invention, reasons for adopting such conditions, and apparatus suitable for the manufacture on a commercial scale will be described.

(a) D1/d (the above-described relation (1)):

In order to prevent the wall thickness of the material that is being pierced from increasing and to minimize the amount of enlargement in the outer diameter of the bottom portion of the material, D1/d must be small. In order for the D1/d value to be reduced, D1 must be made small. However, since each main roll has a cone-like shape, if D1 is reduced, the radius of the roll axis on the inlet side must also be reduced so as to secure the inlet face angle θ 1. This brings about problems that the mechanism for supporting a bearing becomes complex, and that the service life of the bearing is shortened due to deteriorated strength of the bearing. As an alternative measure, D1/d may be reduced by increasing the outer diameter of the billet d. In this case, however, greater loads are applied onto main rolls, and therefore, shortened service life of a bearing cannot be avoided as a result of reduction in strength of the bearing.

These problems can be solved almost perfectly when the D1/d value is made not less than 3 without causing any problem in practice. Thus, the lower limit of D1/d is determined to be 3.

The upper limit of D1/d must be determined on the basis of conditions in which defects are not produced in the outer surface of a hollow shell during a piercing and rolling operation. Moreover, it is also necessary that the conditions be such that the percentage increase in the outer diameter of the bottom portion in which the outer diameter increases does not affect operations in subsequent steps, or in other words, the percentage increase is less than 6%. Considering these requirements, the D1/d value is determined to be not greater than 7. When D1/d is not greater than 7, the outer surface of the resultant hollow shell does not produce defects, and the percentage increase in the outer diameter of the bottom portion in which the outer diameter increases can be made less than 6%. In addition, increase of facility costs can be suppressed to the minimum.

(b) D2/d (the above-described relation (2)):

When the value D2/d is less than 9, incomplete rolling of the bottom of a hollow shell and enlargement of the outer diameter in which the outer diameter at the bottom increases by 6% or more occur. On the other hand, when the value D2/d rises in excess of 16, the resultant hollow shell has an increased number of defects in its outer surface, and in addition, a 6% or greater percentage enlargement in the outer diameter at the bottom occurs. Moreover, since the diameter of disk rolls and the size of the mill housing become excessively great, facility costs increase considerably. Therefore, D2/d is determined to be not less than 9 and not more than 16.

(c) D2/D1 (the above-described relation (3)):

When the value D2/D1 is not more than 2, incomplete rolling of the bottom of a hollow shell and enlargement of the outer diameter in which the percentage increase in outer diameter of a hollow shell at the bottom thereof is 6% or greater. On the other hand, when the value D2/D1 is in excess of 3, billets tend to be engaged with main rolls incompletely to cause generation of an increased number of defects in the outer surface of the hollow shell which has been rolled and a 6% or greater enlargement in the outer diameter at the bottom of a hollow shell. Therefore, the value D2/D1 is determined to be greater than 2 and smaller than 3.

(d) θ 1 (the above-described relation (4)):

If θ 1 is smaller than 2.5° or in excess of 4.5°, incomplete engagement may occur even when the above-described D1/d, D2/d, and D2/D1 are within the range defined in the present invention. Therefore, the range for θ 1 is determined to be not less than 2.5° and not greater than 4.5°.

(e) θ 2 (the above-described relation (5)):

If θ 2 is smaller than 3° or in excess of 6.5°, incomplete rolling of the bottom may occur even when the above-described D1/d, D2/d, and D2/D1 are within the range defined in the present invention. Therefore, the range for θ 2 is determined to be not less than 3° and not greater than 6.5°.

(f) Cross angle γ (the following relation (6)): $10° < \gamma \leqq 25°$

The cross angle γ of a main roll is preferably greater than 10° and equal to or less than 25°. The reason is as follows.

If attempts are made to increase the diameter of the gorge portion of a cone-shaped main roll (D1), the diameter of the roll measured at the end face on the inlet side has to be smaller relative to the diameter of the gorge portion (D1) in order to secure the predetermined inlet face angle θ 1 and the outlet face angle θ 2, whereas there arises the necessity that the roll diameter measured at the end face on the outlet side be considerably increased. The greater the cross angle γ, the more considerable the difference between the roll diameter at the end face on the inlet side and that at the end face on the outlet side.

Moreover, in the piercing and rolling operation with a expansion ratio of the outer diameter of tubes, when the expansion ratio of the outer diameter is increased, use of main rolls each having a prolonged length of the projection, onto the center axis, of the outer face 13 on the outlet side is needed. This calls for a commensurately increased roll diameter at the end face on the outlet side. Therefore, manufacture of such a roll requires increased costs in terms of material and machining, because a larger size of a raw material having an outer diameter greater than that of the roll diameter of the end face on the outlet side is needed. Moreover, when the diameter of a main roll increases, that of a disk roll has to be increased accordingly. As a result, the size of the mill housing increases, and the facility costs increase considerably.

For the above-described reasons, the cross angle γ is preferably not more than 25°.

When the outlet face angle θ 2 is the upper limit 6.5° defined in the present invention, if the cross angle γ is small, the roll diameter of the main roll on the outlet side becomes small, which in turn increases the angle of engagement of the material to be pierced in the rotation direction of main rolls. In such a case, misrolling may occur. Therefore, the cross angle γ is preferably set to be in excess of 10°.

(g) Manufacturing apparatus suited for commercial purposes:

The method of the present invention is applicable to a variety of billets. However, from the viewpoint of commercial production, small outer diameters of billets are not advantageous as they do not afford increased productivity per unit period of time. Meanwhile, if the outer diameter of a billet is excessively large, piercing load have to be great, requiring greater facilities and increased facility costs. For these reasons, the outer diameter of billets suited for the commercial production is preferably between 170 and 400 min. When the outer diameter of a billet is between 170 and 400 mm, the diameter of the grooved portion of a disk roll (D2) is computed to be between 1,530 and 6,400 mm from the above-described relation (2). In the manufacture of disk rolls, however, their size may be restricted; when the diameter of a disk roll is in excess of 4,000 ram, not only manufacture itself becomes difficult, but also manufacturing costs increase considerably. Therefore, the diameter of a disk roll (D2) is preferably between 1,530 and 4,000 mm.

As regards the diameter of the gorge portion of a main roll (D1), when the outer diameter of a billet is between 170 and 400 mm, D1 is computed to be between 510 and 2,800 mm from the above-described relation (1). However, in view of the above-mentioned preferred range of a disk roll, i.e., between 1,530 and 4,000 mm, D1 is limited within the range between 510 and 2,000 mm. Accordingly, the diameter of the gorge portion of a main roll (D1) is preferably between 510 and 2,000 mm.

Apparatus suited for the commercial manufacture using the method of the present invention must have roll sizes which fall within the above-defined range. Moreover, the above-described relations (3), (4), and (5) must be satisfied. When apparatus so constructed is used, not only reduction in facility costs can be achieved, but also hollow shells having good surface quality, as intended by the present invention, can be obtained at enhanced productivity without inviting misrolling during rolling.

EXAMPLES

(Test Example 1)

Using model piercers as shown in FIGS. 11 through 13, which are suited for the practice of the present invention, a piercing and rolling operation was performed under conditions shown in Table 4. Proper ranges for the inlet face angle θ 1 and outlet face angle θ 2 were investigated.

TABLE 4

| | |
|---|---|
| Outer diameter of the billet (d) | 70 min |
| Material of the billet | Carbon steel (0.2% C) |
| Expansion ratio of outer diameter | 1.2–1.5 |
| Ratio of wall thickness (t) to outer diameter of the hollow shell (d):(t/d) | 0.05 |
| Cross angle of the main roll (γ) | 20° |
| Feed angle of the main roll (β) | 8°–16° |
| Diameter of the gorge portion in the main roll (D1) | 350 mm |
| Diameter of the disk roll (D2) | 850 mm |
| Skew angle of the disk roll (δ) | 0°, 3°, 6° |
| Spacing of main rolls (Rg) | 61.5 mm |
| Spacing of disk rolls (Dg) | 70.5 mm |
| Inlet face angle of the main roll (θ 1) | 2°–5° |
| Outlet face angle of the main roll (θ 2) | 2.5°–7.5° |

The results of investigation as to incidence of incomplete engagement and incomplete rolling of the bottom during the piercing and rolling operation are shown in Table 5. In Table 5, "X" indicates that incomplete engagement or incomplete rolling of the bottom has occurred, "○" indicates that these problems have not occurred, and "–" indicates that occurrence of incomplete rolling of the bottom could not be judged because incomplete engagement occurred.

TABLE 5

| | | | | Result of the tests** | |
|---|---|---|---|---|---|
| Category | Test No. | Inlet face angle θ 1(°) | Inlet face angle θ 2(°) | Incomplete engagement | Incomplete rolling of the bottom of the tube materials |
| Products of the Invention | 1 | 2.5 | 4 | ○ | ○ |
| | 2 | 3 | 3 | ○ | ○ |
| | 3 | 3 | 4 | ○ | ○ |
| | 4 | 3 | 6.5 | ○ | ○ |
| | 5 | 4.5 | 4 | ○ | ○ |
| Comparative Products | 6 | 2* | 4 | X | — |
| | 7 | 5* | 4 | X | — |
| | 8 | 3 | 2.5* | ○ | ○ |
| | 9 | 3 | 7.5* | ○ | ○ |

*: Outside the range of the present invention
**: "○" stands for no-occurence, and "X" stands for occurence.

As is apparent from Table 5, in the Example Products of the present invention, which were manufactured in Test Nos. 1 through 5 under conditions such that the inlet face angle was in the range of from 2.5° to 4.5°, the outlet face angle was in the range of from 3° to 6.5°, and relations (4) and (5), as well as relations (1) through (3), were satisfied, no incomplete engagement or incomplete rolling of the bottom occurred. Moreover, the piercing and rolling operations were performed stably even when the expansion ratio was as high as between 1.15 and 1.45.

In contrast, in the cases of Comparative Products, which were manufactured with either the inlet face angle or the outlet face angle not satisfying the above-described relation (4) or (5), incomplete engagement or incomplete rolling of the bottom occurred.

(Test Example 2)

Using the model piercers employed in Test Example 1, a piercing and rolling operation was performed under the conditions shown in Table 6, so as to confirm proper ranges for the values D1/d, D2/d, and D2/D1.

TABLE 6

| | |
|---|---|
| Outer diameter of the billet (d) | 70 mm |
| Material of the billet | Low alloy steel (2.25% Cr) |
| Expansion ratio of outer diameter | 1.15–1.45 |
| Ratio of wall thickness (t) to outer diameter of the hollow shell (d):(t/d) | 0.04–0.06 |
| Cross angle of the main roll (γ) | 25° |
| Feed angle of the main roll (β) | 8°–16° |
| Inlet face angle of the main roll (θ 1) | 3° |
| Outlet face angle of the main roll (θ 2) | 4°, 6° |
| Skew angle of the disk roll (δ) | 0°, 3°, 6° |
| Spacing of main rolls (Rg) | 61.5 mm |
| Spacing of disk rolls (Dg) | 70.5 mm |

The results of investigation as to incidence of incomplete engagement and incomplete rolling of the bottom during the piercing and rolling operation, defects in outer surfaces such as guide marks and tucking, and enlargement of the outer diameter at the bottom portion are shown in Table 7. In Table 7, "χ" indicates that misrolling such as incomplete engagement and incomplete rolling of the bottom has occurred, that defects in the outer surface were produced, or that the enlargement of the outer diameter at the bottom was in excess of 6%, whereas "○" indicates that none of these problems have occurred.

TABLE 7

| | | | | | Results of the tests** | | |
|---|---|---|---|---|---|---|---|
| Category | Test No. | D1/d | D2/d | D2/D1 | Miss roll | Defects in the outer surface | Enlargement of outer diameter in the bottom |
| Examples of the Invention | 1 | 3.5 | 9 | 2.57 | ○ | ○ | ○ |
| | 2 | 4 | 11 | 2.75 | ○ | ○ | ○ |
| | 3 | 4.5 | 12 | 2.67 | ○ | ○ | ○ |
| | 4 | 5 | 11 | 2.2 | ○ | ○ | ○ |
| | 5 | 5.5 | 16 | 2.67 | ○ | ○ | ○ |
| Comparative Examples | 6 | 2.5* | 9 | 3.6* | X | ○ | X |
| | 7 | 6 | 17* | 2.83 | X | X | X |

*: Outside the range of the present invention
**: "○" stands for no-occurence, and "X" stands for occurence.
Defects in the outer surface As is apparent from Table 7, in the Example Products of the present invention, which were manufactured in Test Nos. 1 through 5 under conditions such that all the relations (1) through (5) were satisfied, neither misrolling nor generation of defects in the outer surface occurred. In addition, 6% or greater enlargement of the outer diameter was not observed in bottom portions. Thus, a stable piercing and rolling operation was possible at an expansion ratio of as high as between 1.15 and 1.45.

In contrast, in the cases of Comparative Products, which were manufactured in Test Nos. 6 and 7, with at least one of the conditions represented by relations (1) through (5), misrolling attributed to incomplete engagement or incomplete rolling of the bottom occurred, or defects were generated in the outer surface. In addition, 6% or greater enlargement of the outer diameter was observed at the bottom.

(Test Example 3)

Using the model piercers employed in Test Example 1, a piercing and rolling operation was performed under the conditions shown in Table 8.

TABLE 8

| | |
|---|---|
| Outer diameter of the billet (d) | 50–100 mm |
| Material of the billet | Carbon steel (0.2% C) and Stainless steel (18% Cr—8% Ni—1% Nb) |
| Expansion ratio of outer diameter | 1.2–1.5 |
| Ratio of wall thickness (t) to outer diameter of the hollow shell (d):(t/d) | 0.05 |
| Cross angle of the main roll (γ) | 20° |
| Feed angle of the main roll (β) | 8°–16° |
| Diameter of the gorge portion in the main roll (D1) | 250–450 mm |
| Diameter of the disk roll (D2) | 500–1200 mm |
| D1/d | 2.5–10 |
| D2/d | 6–20 |
| Inlet face angle of the main roll (θ 1) | 3°, 3.5° |
| Outlet face angle of the main roll (θ 2) | 4°, 6° |
| Spacing of main rolls (Rg) | 43.9–87.9 mm |
| Spacing of disk rolls (Dg) | 50–103 mm |

Figure 16:
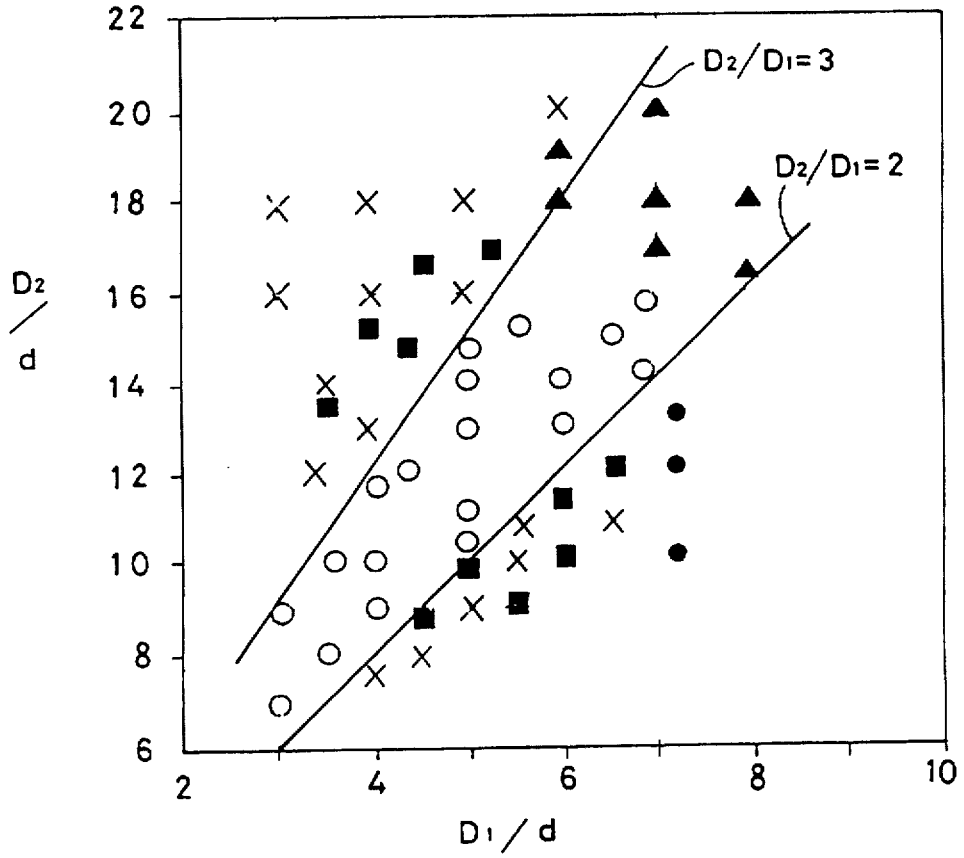
FIG. 16 is a graph showing the effect of D1/d, D2/d, and D2/D1 on the results of piercing and rolling, wherein D1 d is the ratio of the diameter of the gorge portion of a main roll (D1) to the outer diameter of a billet (d), which is the material to be pierced and rolled; D2/d is the ratio of the diameter of the grooved portion of a disk roll (D2) to the outer diameter of a billet (d); and D2/D1 is the ratio of the diameter of the grooved portion of a disk roll (D2) to the diameter of the gorge portion of a main roll (D1). In this graph, "○" indicates that the piercing and rolling operation did not involve any problem; and black dots, black triangles, and black squares indicate that problems were involved such as generation of defects in the surfaces of hollow shells, significant enlargement of the outer diameter of the bottom portions of the shells, etc.

FIG. 16 shows the results of tests conducted while varying the values D1/d and D2/d. In FIG. 16, "χ" indicates that incomplete engagement or incomplete rolling of the bottom was observed; black dots indicate that defects occurred on the interior surface of a hollow shell made of a material of poor workability, such as stainless steel and high alloy steel; black triangles indicates that defects were generated on the outer surface of a hollow shell, including guide marks in the outer surface generated as a result of seizure by the sliding surface of a disk roll and scratches in the outer surface caused by an increased frictional force applied onto the sliding surface of a disk roll; black squares indicate that 6% or greater enlargement of the outer diameter of the bottom portion occurred; and "○" indicates that no problem occurred in the piercing and rolling operation.

When the values D1/d, D2/d, and D2/D1 are within the ranges defined by the present invention, satisfying relations (1), (2), and (3), respectively, it was confirmed that incomplete engagement, incomplete rolling of the bottom of a hollow shell, generation of defects on the interior surface of a hollow shell made of a material of poor workability, generation of defects on the outer surface of a hollow shell, or 6% or greater enlargement of the outer diameter at the bottom portion of a hollow shell never occurred. In contrast, when these values did not fall within the ranges defined by the present invention, it was proven that hollow shells had defects both on the internal wall surface and outer surface thereof, or generated a significant increase on outer diameter of the bottom portion thereof.

Industrial Applicability

As described above, according to the piercing-rolling method and the piercing-rolling apparatus for seamless tubes, it is possible to manufacture, from round bar-like billets of carbon steel, low alloy steel, or high alloy steel, hollow shells without causing misrolling such as incomplete engagement of billets or incomplete rolling of the bottom. The resultant hollow shells have a minimized number of defects on the outer surface, and enlargement of the outer diameter at the bottom portion is suppressed. As a result, the end products of seamless tubes have remarkably excellent quality. Moreover, since the method of the invention allows a piercing and rolling operation to be performed stably or smoothly at an elevated expansion ratio of not less than 1.15, the method not only broadens the range of seamless tubes that can be manufactured but also improves the productivity. Thus, the method and apparatus of the present invention enables manufacture of a wider variety of seamless tubes at an improved productivity and reduced cost, thereby achieving remarkable advantages in the manufacture of seamless tubes.

What is claimed is:

1. A piercing and rolling method for manufacturing a seamless tube using a piercing and rolling apparatus which is provided with a pair of cone-shaped main rolls and a pair of disk rolls, each pair being arranged in a opposing manner with a pass line therebetween as a center axis, and a plug whose center axis coincides with the pass line, wherein a material to be pierced and rolled is advanced while being spirally rotated by the drive rotation of the main rolls, thereby forming a hollow shell, comprising piercing and rolling a billet under conditions such that D1/d which represents the ratio of the diameter of a gorge portion of a main roll (D1) to the outer diameter of a billet to be pierced (d); D2/d which represents the ration of the diameter of a grooved portion of a disk roll (D2) to the outer diameter of the billet (d) ; D2/D1 which represents the ratio of the diameter of the grooved portion of a disk roll (D2) to the diameter of the gorge portion of a main roll (D1); θ 1 which represents an inlet face angle of the main rolls; and θ 2 which represents an outlet face angle of the main rolls satisfy the following relations (1), (2), (3), (4), and (5), respectively:

$$3 \leq D1/d \leq 7 \quad (1)$$

$$9 \leq D2/d \leq 16 \quad (2)$$

$$2 < D2/D1 \leq 3 \quad (3)$$

$$2.5 \leq \theta\ 1 \leq 4.5°, \quad (4)$$

and $$3° \leq \theta\ 2 \leq 6.5° \quad (5).$$

2. The piercing and rolling method for the manufacture of a seamless robe according to claim 1, wherein a cross angle γ between the pass line and the center axis of one of the pair of main rolls as viewed in a side view satisfies the following relation (6):

$$10° < \gamma \leq 25° \quad (6).$$

3. A piercing and rolling apparatus for manufacturing a seamless tube comprising a pair of cone-shaped main rolls and a pair of disk rolls, each pair being arranged in an opposing manner with a pass line therebetween as a center axis, wherein the diameter of a gorge portion of a main roll (D1) is between 510 and 2000 mm inclusive, the diameter at a grooved portion of a disk roll (D2) is between 1,530 and 4,000 mm inclusive, and the ratio of the diameter at the grooved portion of a disk roll (D2) to the diameter of the gorge portion of a main roll (D1), D2/D1, an inlet face angle θ 1, and an outlet face angle θ 2 satisfy the following relations (3), (4), and (5), respectively:

$$2 < D2/D1 \leq 3 \quad (3)$$

$$2.5° \leq \theta\ 1 \leq 4.5°, \quad (4)$$

and $$3° \leq \theta\ 2 \leq 6.5° \quad (5).$$

* * * * *